United States Patent [19]

Bubley et al.

[11] 4,276,826

[45] Jul. 7, 1981

[54] SQUEEGEE AND FLOOD BAR ACTUATOR

[75] Inventors: Henry J. Bubley, Deerfield; Claude H. Oltra, Chicago, both of Ill.

[73] Assignee: American Screen Printing Equipment Company, Chicago, Ill.

[21] Appl. No.: 118,920

[22] Filed: Feb. 6, 1980

[51] Int. Cl.[3] ..... B41F 15/36

[52] U.S. Cl. ..... 101/123; 101/126

[58] Field of Search ..... 101/114, 123, 126

[56] References Cited

U.S. PATENT DOCUMENTS

| | | | |
|---|---|---|---|
| 3,143,961 | 8/1964 | Jaffa | 101/123 |
| 3,263,603 | 8/1966 | Fuchs | 101/123 |
| 3,859,917 | 1/1975 | Bubley et al. | 101/126 |
| 3,885,493 | 5/1975 | Jaffa | 101/123 |
| 3,955,501 | 5/1976 | Bubley et al. | 101/123 |

FOREIGN PATENT DOCUMENTS

| | | | |
|---|---|---|---|
| 125712 | 7/1947 | Australia | 101/123 |
| 1178062 | 12/1958 | France | 101/123 |
| 1282956 | 12/1961 | France | 101/123 |
| 1498267 | 1/1978 | United Kingdom | 101/123 |
| 515661 | 9/1976 | U.S.S.R. | 101/123 |

*Primary Examiner*—Clyde I. Coughenour

*Attorney, Agent, or Firm*—Robert E. Wagner

[57] ABSTRACT

In a screen printing press having a squeegee and flood bar mounted on a movable support carriage, a movable actuator means is provided by the present invention which includes a pivotal lever having a brake pad on its upper end to firmly engage an upper braking surface at the point of transition from the flood mode to the print mode and vice versa in response to change in direction of movement of the carriage, for securing the carriage in a fixed position while the squeegee and flood bars shift position in preparation for the print or flood stroke.

9 Claims, 5 Drawing Figures

25
45
36'
36
29
81
31
41
15
66
70
57
53
49
51
39
33
80
58
37
28
40
43
30
61
60
39
49
80
34
21
27
23
28'
29
33
63
60'
40'
30'
31
46
44
41
57

SQUEEGEE AND FLOOD BAR ACTUATOR

DESCRIPTION

Technical Field

In a screen printing press having a squeegee and flood bar mounted on a movable support carriage, an improved actuator means is provided for shifting the squeegee and flood bar from the flood condition to the print condition in a smooth and efficient operation in response to change in direction of the support carriage.

Background Prior Art

The present invention relates generally to the field of screen printing and, more specifically, to an actuating means for smoothly and automatically shifting the position of the squeegee and flood bars relative to the printing screen at the end of the print and flood strokes, respectively, regardless of the length of the stroke.

Screen printing presses include a squeegee and flood bar which generally are mounted to oscillate from the print mode to flood mode during the printing cycle. In the print mode, the squeegee is pivoted downwardly to contact the printing screen, and is moved to force ink through the screen on to the work piece or stock to be printed. At the end of the print mode or stroke, the squeegee is elevated and flood bar lowered into contact with the printing screen in order to coat the screen with ink in preparation for another print stroke. The cycle is then repeated.

An important part of the printing cycle is to provide means for shifting the position of the squeegee and flood bar smoothly and efficiently at the end of the print and flood strokes and to control all of the ink within the screen. It can be appreciated that the flood bar and squeegee must be moved into contact with the screen immediately after completion of the flood or print stroke before the cycle continues to optimize printer speed and efficiency.

The problem of quickly and positively shifting the position of the squeegee and flood bar becomes more accentuated as the speed of operation of automatic screen printers has increased. In our prior U.S. Pat. No. 3,859,917 entitled "Screen Printing Press", a printing press is disclosed having a squeegee and flood bar mounted on a movable carriage support. As described in detail in the 3,859,917 patent, stops are provided on the screen frame and support and engage the squeegee and flood bar carriage at the end of the print and flood modes causing the squeegee and flood bar to shift from the flood to print mode. Other forms of such mechanisms include the use of a drive rod which is directly connected to the squeegee and flood bar carriage and shifts from the print to flood mode in response to a change in direction.

It has been found that at high speeds of operation, means of the type disclosed in the 3,859,917 patent, or other known means to shift from the flood to print condition involving the contact of movable support with a fixed surface, required constant adjustment, are noisy and unreliable in operation and can jar or vibrate until the entire press is misadjusted. Such presses depend on the head position to effect the change over and are, therefore, inefficient in controlling the ink within the screen. The mechanisms which rely on a lever directly connected to the squeegee and flood bar support carriage require some type of a braking mechanism to prevent movement of the carriage before the squeegee and flood bar have completely shifted position. Prior art brake means have proved to be unacceptable for a variety of reasons, the most prevalent of which being the need for virtually constant adjustment of the drag of the brake. Too heavy or too tight adjustment causes wear and unecessary loading on the motor; too light adjustment results in failure to make the change over from one function to the other.

SUMMARY OF THE INVENTION

The subject invention provides a means of shifting the position of the squeegee and flood bar in a smooth pivotal motion without requiring engagement of the squeegee and flood bar carriage support with a fixed stop or relying on a drive rod, thus eliminating the problems of prior art devices. As discussed more fully below, a pivoting actuator means is provided herein including a lever having a pad pinned to its upper end which is formed of material such as used in friction-type brakes. The pad lightly engages a smooth surface mounted to the press immediately above the path of travel of the squeegee and flood bar along the printing screen. At the end of the flood or print stroke, the press drive which reciprocates the flood and squeegee bars along the printing screen reverses direction. In response to the change in direction of the press drive, the pad of the novel actuator means herein engages the smooth surface with sufficient force to prevent lateral movement of the squeegee and flood bar until a novel linkage and roller means, described below, completely shift the position of the squeegee and flood bars.

The novel actuator means for the squeegee and flood bars herein thus depends on the frictional engagement between the brake pads mounted on a pivotal lever, and a smooth braking surface which are in continuous but light contact to assure complete shifting movement of the squeegee and flood bars. The lever pivots immediately in response to a change in direction of movement of the squeegee and flood bars and holds the carriage support substantially stationary as the squeegee and flood bar shift into contact with the screen. It has been found that the novel actuator means of the present invention provides a much more efficient, smoother and positive transition from the print mode to the flood mode and vice versa at high speeds of operation that known types of shifting means, with a minimum of adjustment for various screen sizes, as discussed below. Notwithstanding its reliable and positive action, the actuator means requires a minimum of parts due to its novel design.

Therefore, it is an object of the present invention to provide a squeegee and flood bar actuator for smooth and efficient shifting of the squeegee and flood bar at the end of the print and flood modes, respectively, which is responsive to changes in direction of the squeegee and flood bar carriage.

It is another object of the present invention to provide an actuator means having a brake pad in light frictional engagement with a smooth braking surface on a screen printing press; the brake pad firmly engaging the smooth surface at the point of transition from the flood to print mode and preventing movement of the support carriage until the flood bar and squeegee completely shift position.

It is still another object of the present invention to provide a screen printing press in which the squeegee and flood bars are shifted by a novel linkage and roller means acting in cooperation with the actuator means.

BRIEF DESCRIPTION OF SEVERAL VIEWS OF DRAWINGS

Objects in addition to the foregoing will become apparent upon consideration of the following description taken in conjunction with th accompanying drawings wherein.

DETAILED DESCRIPTION

Figure 1:
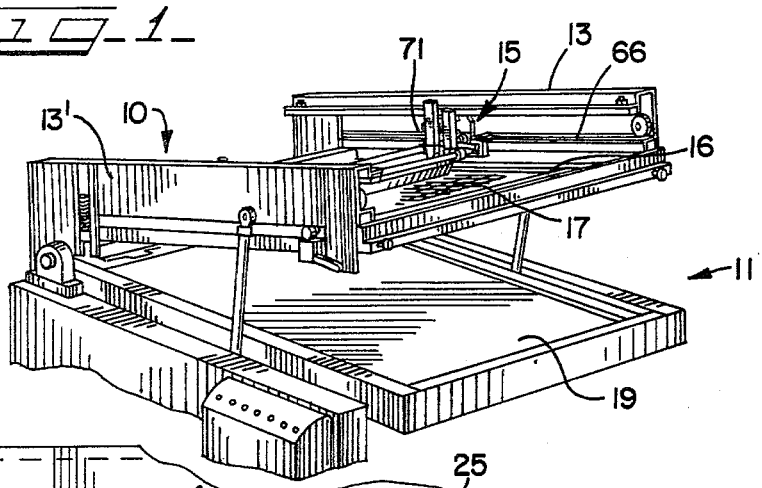
FIG. 1 is a partial perspective view of a screen printing press showing the positions of the squeegee and flood bar on the press head relative to the printing screen.

Referring now to the drawings, and in particular to FIG. 1, a screen printing press, labeled generally with the reference 11, is provided with a press head 10 having arms 13 and 13′ along which a support carriage 15 is reciprocated by a chain 58, which in turn is driven by a press drive means (not shown) of known type. Arms 13 and 13′ support a screen chase 16 to which a screen 17 is removably attached.

The press head 10 is movable toward and away from the press bed 19 of printer 11, for the printing of work placed in a registered position thereon. A flood bar 21 and squeegee 23 (FIGS. 2 and 3) are supported on carriage 15 for engagement with the screen 17 during the flood mode and print mode, respectively. In the print mode or stroke, press head 10 is in a down or print mode condition over the bed 19 with the screen 17 essentially in contact with work to be printed, such as paper, cardboard or any suitable print surface. The squeegee 23 is moved with carriage 15 along arm 13 and 13′ across screen 17 during the print mode, after which the press head 10 moves upwardly from the press bed 19. Once the print stroke is completed, flood bar 21 is lowered onto the screen 17 while the squeegee 23 is raised in preparation for the flood mode. In the flood mode, flood bar 21 is moved in the opposite direction along screen 17 to move the ink remaining on screen 17 to the opposite end of support carriage 15, in preparation for the next print stroke. As mentioned above, the present invention is directed to a means of positively and efficiently shifting the position of the flood bar 21 and squeegee 23 relative to screen 17 at the end of the flood and print modes, respectively, without the use of stops or a lever connected to the press drive.

Figure 2:
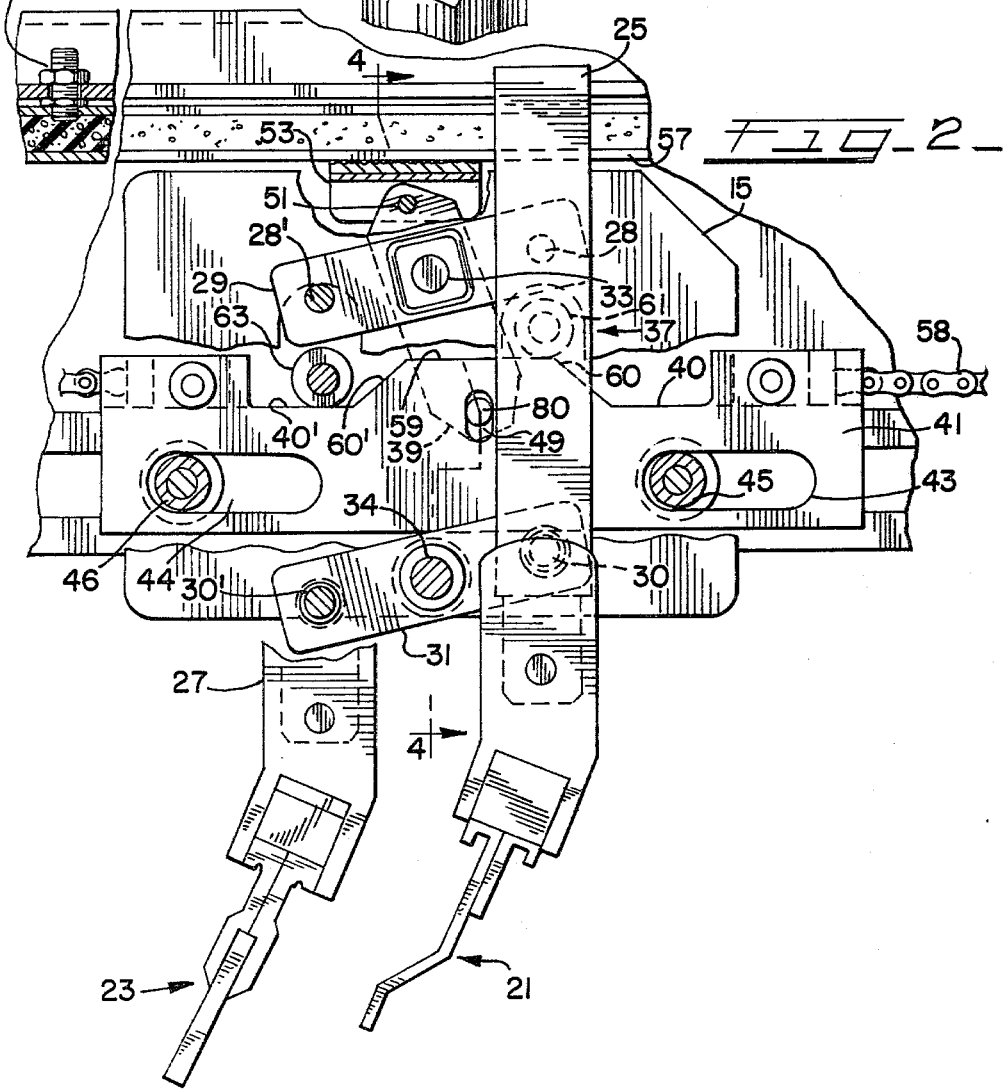
FIG. 2 is a partial cross-sectional view in full elevation showing the orientation of the squeegee and flood bars during the print mode.
Figures 3, 4, 5:
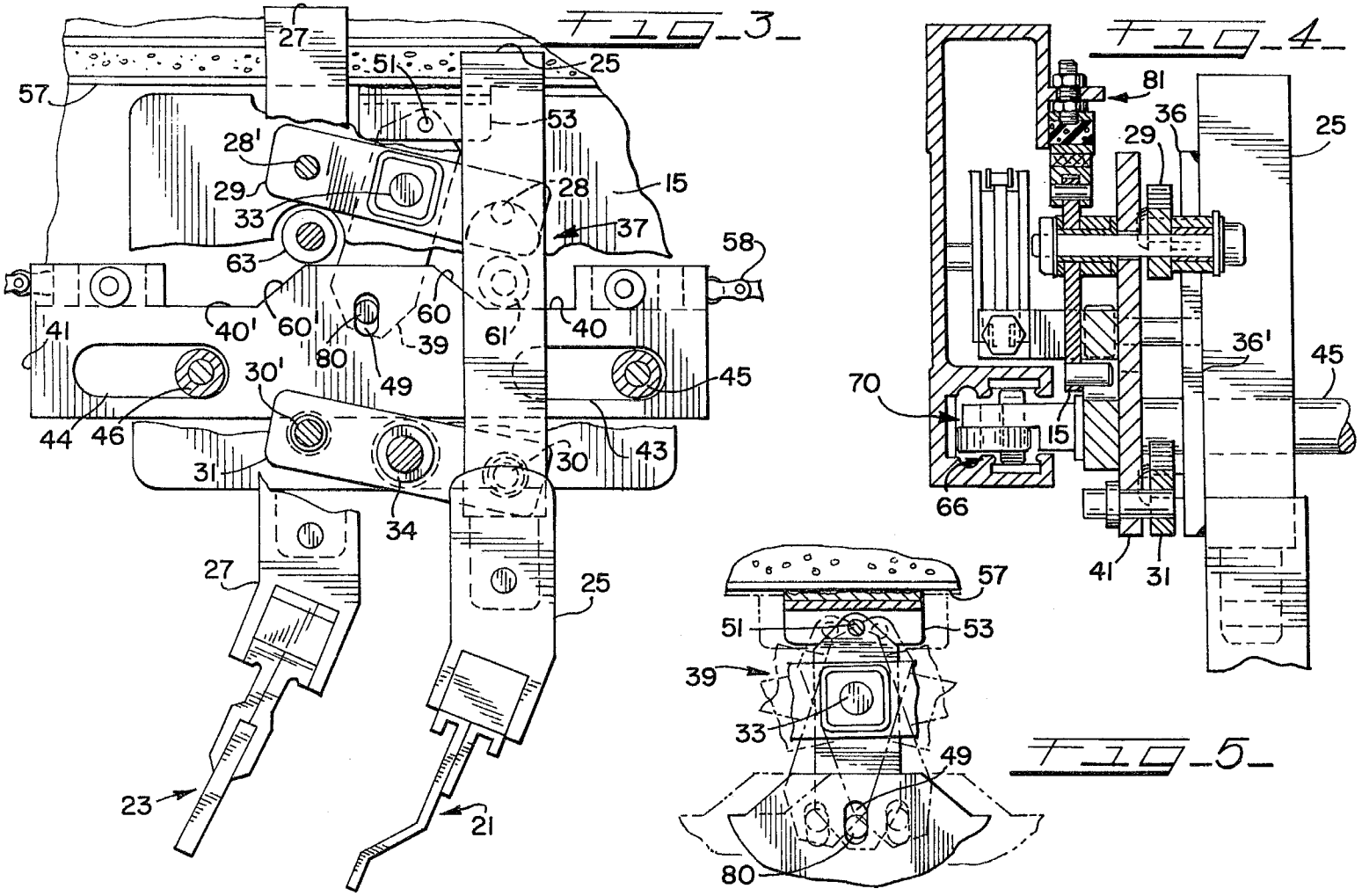
FIG. 3 is a partial cross-sectional view in full elevation of the squeegee and flood bars in the flood mode.
FIG. 4 is a partial cross-sectional view taken generally along line 4—4 of FIG. 2.
FIG. 5 is an enlarged detailed fragmentary elevational view of the actuator of the present invention showing in phantom lines the positions the lever and related parts assume during the print and flood modes, and depicting in solid lines the relationship of such parts intermediate of the two modes.

Referring now to FIGS. 2 and 3, flood bar 21 and squeegee 23 are mounted to arms 25 and 27, respectively. Arms 25 and 27 are supported by pins 28 and 28′ which attach at one end to an upper pivot bracket 29, and pins 30 and 30′ which attach at one end to a lower pivot bracket 31. The other ends of pins 28 and 28′ and 30 and 30′ are attached to spacer plates 36 and 36′ which extend along arms 25 and 27, respectively, between the upper and lower pivot brackets 29 and 31. The pivot brackets 29 and 31 are pivotally mounted to carriage 15 by a central pin 33 and 34, respectively. The pivot brackets 29 and 31, with the mounting plates 36 and 36′, form a parallelogram-shaped support identified generally by the reference 37 which is pivoted about central pins 33 and 34 to alternately raise and lower flood bar 21 and squeegee 23 into contact with screen 17, as discussed more fully below.

Press arm 13 is formed with a track 66 extending the length thereof which receives a pair of roller assemblies 70 and 71, each mounted to one end of a pair of support shafts 45 and 46 (see FIG. 4). The other press arm 13′ has an identical cross section and roller engagement, which are not shown herein. Support shafts 45 and 46 extend through elongated slots 43 and 44 formed in a shuttle 41, and are removably attached to carriage 15. Thus shuttle 41 is captively disposed between support arms 25 and 27, and carriage 15, and is movable relative thereto along slots 43 and 44 for purposes to become apparent below.

The shuttle 41 has oppositely facing cam surfaces formed by flat surfaces 40 and 40′ joined by angulated surfaces 60 and 60′ which extend to an elevated surface 59. Cam followers are formed by pivot rollers 61 and 63 which are mounted in a position on arms 25 and 27, respectively, such that when one roller rests on the elevated surface 59 or up side of the cam, the other roller contacts the planar surface 40 or low side of the cam on the shuttle 41. As discussed below, the movement of rollers 61 and 63 along the cam surfaces of the shuttle 41 functions to alternately shift the flood bar 21 and squeegee 23 up and down into contact with screen 17.

An actuator lever 39 is joined by a pin 51 to a brake pasdd 53, having a braking surface which lightly engages a smooth braking plate 57. A resilient pad of rubber, plastic foam or any suitable equivalent backs the smooth plate 57, formed of metal or an equivalent, which is adjustably mounted along the length of support carriage arm 15 immediately above actuator 39. Brake pad 53 and plate 57 are in light engagement during the entire print/flood cycle. Adjustment is provided through threaded supports 81 (FIG. 4). The other end of actuator lever 39 is pivotally attached through a pin 80 which is received in a lost-motion slot 49 formed in shuttle 41.

As discussed above, prior art printing presses shift the position of the flood bar and squeegee relative to the printing screen by some form of stop on the support carriage at the end of the print and flood strokes. It is apparent that shifting means of this type must be carefully adjusted for each different screen size used, and to compensate for minor changes and wear in the drive. Those prior art presses which include a lever attached directly to the squeege-flood bar support carriage for shifting the squeegee and flood bar require a brake means. Prior to the present invention, known types of brakes were difficult to properly adjust and were unreliable in operation. The reduced speed of both press operation and set-up time required by such prior art devices are substantially eliminated by the operation of actuator lever 39 in cooperation with pivot rollers 61 and 63, as shown in FIGS. 2, 3 and 5.

In the print mode (FIG. 2), a drive chain 58 associated with the press drive means (not shown) moves support carriage 15 in the direction indicated. At the initiation of the print stroke, the shuttle 41 is moved relative to the carriage 15 along slots 43 and 44, which ride on support shafts 45 and 46. Shuttle 41 moves relative to carriage 15 until support shafts 45 and 46 contact the edge of slots 43 and 44, at which time the shuttle 41 moves in unison with support carriage 15 with the squeegee 23 in contact with the screen. During the print mode, the roller 61 rides along ramp 60' up to the raised surface 59 to planar surface 40.

As the shuttle moves long slots 43 and 44, the brake pad 53 firmly contacts the plate 57 to prevent movement of the carriage 15 (see FIG. 5). As movement of the shuttle 41 relative to the carriage 15 continues, the actuator lever 39 pivots and locks into the position indicated in FIG. 2, which releases the brake pad 53 from plate 57 to allow carriage 15 to move with shuttle 41. Rollers 61 and 63 and actuator lever 39 maintain the relationship shown in FIG. 2 throughout the travel of the support carriage 15 in the print mode.

The relative position of the squeegee 23 and flood bar 21 after they have been shifted from the print mode shown in FIG. 2 to the flood mode is shown in FIG. 3. The change from print to flood mode occurs immediately as the press drive chain 58 reverses direction. Force is exerted on the drive chain 58 in the direction of the arrows shown in FIG. 3. Since the shuttle 41 is movable relative to the carriage assembly 15 along slots 43 and 44, slight force on the shuttle 41 causes the brake pad 53 to positively engage the plate 57, which locks the carriage assembly 15 against movement. The shuttle 41 continues to move in the direction of the arrows shown in FIG. 3, causing the rollers 61 and 63 to move from the condition shown in FIG. 2 to the condition shown in FIG. 3. Throughout this movement, the lower end of the actuator lever 39 moves with the shuttle 41, while the upper end remains fixed relative to the braking surface 57 in response to the holding action of the brake pad 53. As seen in solid lines in FIG. 5, the actuator lever 39 reaches the dead center position when the shuttle 41 is midway through its movement and both rollers are on the angulated surfaces or ramps 60 and 60'. The position of the actuator lever 39 when the shuttle 41 is shifted completely to the left is shown in dotted lines in FIG. 5 and solid lines in FIG. 3. At this point, the actuator lever 39 has moved past center, releasing the brake pad 53 so that it remains only in light contact with the surface 57. At this point, the support shafts 45 and 46 in the slots 43 and 44 engage the opposite ends permitting the entire carriage assembly 15 to move under the force of the chain 58.

During the movement of the shuttle 41 to the left in the flood mode, the roller 63 and roller 61 move to the final location shown in FIG. 3. This causes the squeegee arm 27 to rise as roller 63 moves along ramp 60 to elevated surface 59, and the flood bar arm 25 to lower the flood bar 21 into engagement with the screen as roller 61 moves downwardly on ramp 60' to flat surface 40' of shuttle 41.

A unique relationship between the ends of the actuating lever 39 provides for reliable shifting of the flood bar 21 and squeegee 23 at the end of a flood or print stroke. As can been seen in FIGS. 2, 3 and 5, the pivot rod 33 of the actuator 39 is located closer to the pivot pin 51 supporting the brake pad 53 than the pin 80 located in the lost-motion slot 49 in the shuttle 41. This prevents the carriage assembly 15 from moving before the shuttle 41 has shifted to the "home" or final position shown in FIGS. 2 and 3 wherein support shafts 45 and 46 engage the edges of slots 43 and 44. The fact that the distance from the center of the pin 51 to the center of the rod 33 is less than from the center of the pin 80 to the rod 33 assures that the carriage 15 will not move even if the shuttle 41 should stick or bind as the chain 58 reverses direction. Since the brake pad 53 is in firm, positive engagement with the braking surface 57, the carriage assembly 15 is prevented from moving until the shuttle 41 has completed its movement to the home position. Should the shuttle 41 stick at any point during the pivoting or shifting of the actuator lever 39, the braking force applied by brake pad 53 against braking surface 57 is increased up to the mid-point of the shuttle 41 movement. Throughout the latter half of the movement of shuttle 41, the braking force is gradually released, however the inertia of the shuttle 41 coupled with the rollers 61 and 63 being on the down slope of the cams 60 and 60' assures that the squeegee 23 or flood bar 21 will be driven to the home or final position.

In constrast to prior art braking devices, the braking force or pressure herein is applied only at the point of transition between the flood and print stroke where the squeegee 23 and floor bar 21 are shifted. Moreover, by linking the pivoting of actuator lever 39 directly to the movement of parallelogram support 37, and, in turn, rollers 61 and 63, the squeegee 23 and flood bar 21 are positively forced to shift position before carriage 15 can move with shuttle 41.

It can be appreciated that as soon as the chain 58 changes direction, the shift from print mode to flood mode will occur. Accordingly, the print stroke can be shortened or lengthened to any desired degree with no adjustment in the carriage assembly 15 required. The positive nature of the squeegee 23 and flood bar 21 actuation assure that it will always occur and thus misprints are substantially eliminated. In addition, the carriage 15 of the present invention may be scaled up or down to fit any press size as long as the relative relationship of the moving parts of the carriage 15 is maintained.

We claim:

1. In a screen printing press including a frame, a printing bed supported on said frame to receive work to be printed, a press head pivotally mounted to said frame for angular movement relative to said printing bed, a carriage mounted to said press head for reciprocation therealong relative to said printing bed, a screen removably mounted to said carriage in a position above said work on said printing bed, a squeegee and flood bar mounted to said carriage and being movable therewith, drive means associated with said carriage and being operable to reverse direction for moving said squeegee across said screen in a first direction for the print stroke, and for moving said flood bar across said screen in the reverse direction for the flood stroke, the improvement comprising:

a chassis movably mounted to said carriage, said chassis having an upper edge including a raised surface joined at each end to an angular camming surface, said camming surfaces extending to generally flat planar surfaces;

upper and lower brackets pivotally mounted to said carriage;

a pair of support arms for supporting said squeegee and said flood bar, said squeegee support arm being mounted at one end of said upper and lower brackets, said flood bar support arm being mounted to the opposite end of said upper and lower brackets, said support arms being pivotal with said upper and lower brackets;

first roller means mounted to said squeegee support arm and being movable along said upper edge of said chassis, said first and second roller means being mounted to said squeegee and flood bar such that one of said roller means moves into contact with said raised surface of said chassis for shifting the position of said squeegee and flood bar relative to said screen, said squeegee contacting said screen for the print stroke as said second roller means contacts said raised surface and said flood bar contacting said screen for the flood stroke as said first roller means contacts said raised surface;

a fixed surface mounted to said press head above said carriage; and, actuator means including a lever having an engaging means pinned at one end, the other end of said lever being pinned to said chassis, said lever being pivotal about a pivot rod attaching to said carriage, said engaging means lightly contacting said fixed surface during said print and flood strokes, said engaging means engaging said fixed surface as said drive means reverses direction from said print stroke to said flood stroke to secure said carriage in a fixed position as said roller means move along said upper edge of said chassis for shifting the position of said squeegee and flood bar, whereby said carriage remains essentially stationary as said drive means reverses the direction of movement for said print and flood strokes to allow said first and second roller means to completely shift the position of said squeegee and flood bar relative to said screen prior to movement of said carriage.

2. The screen printing press of claim 1 wherein said lever is pivotally mounted to said rod on said carriage at a point at least partially above the midpoint of said lever.

3. The screen printing press of claim 1 wherein said fixed surface is formed of a smooth metal and includes a resilient backing, said fixed surface having adjustment means for varying the pressure of said fixed surface against said engaging means.

4. In a screen printing press including a frame, a printing bed supported on said frame to receive work to be printed, a press head pivotally mounted to said frame for angular movement relative to said printing bed, a carriage mounted to said press head for reciprocation therealong relative to said printing bed, a screen removably mounted to said carriage in a position above said work on said printing bed, a squeegee and flood bar mounted to said carriage and being movable therewith, drive means associated with said carriage and being operable to reverse direction for moving said squeegee across said screen in a first direction for the print stroke, and for moving said flood bar across said screen in the reverse direction for the flood stroke, the improvement comprising:

a fixed surface mounted to said press head above said carriage;

a chassis movably mounted to said carriage, said chassis having an upper surface;

a parallelogram support pivotally mounted to said carriage, said squeegee being mounted to one end of said parallelogram support and being pivotal therewith relative to said screen, said flood bar being mounted to the other end of said parallelogram support and being pivotal therewith relative to said screen;

first and second roller means, said first roller means being mounted to one end of said parallelogram support and being movable along said upper surface for raising and lowering said squeegee relative to said screen, said second roller means being mounted to the other end of said parallelogram support and being movable along said upper surface for raising and lowering said flood bar, said first and second roller means cooperating to simultaneously raise said squeegee while lowering said flood bar, and to lower said squeegee while raising said flood bar; and, actuator means pivotally mounted to said carriage and attaching at one end of said chassis, said actuator means having an engaging means at the other end lightly contacting said fixed surface during said print and flood strokes, said engaging means firmly contacting said fixed surface in response to a change in direction of movement of said carriage to secure said carriage from movement as said first and second rollers raise and lower said squeegee and flood bar relative to said screen for said print and flood strokes.

5. The screen printing press of claim 4 wherein said parallelogram support includes upper and lower brackets pivotally mounted to said carriage, and a pair of support arms for supporting said squeegee and said flood bar, said squeegee support arm being mounted at one end of said upper and lower brackets, said flood bar support arm being mounted to the other end of said upper and lower brackets, said support arms being pivotal with said upper and lower brackets to alternately lower said squeegee and flood bar into contact with said screen.

6. The screen printing press of claim 4 wherein said upper surface of said chassis includes a raised surface joined at each end to an angular surface, said angular surfaces extending to generally flat planar surfaces, said first and second rollers being mounted to said parallelogram support such that as one roller contacts said raised surface the other roller contacts a flat planar surface for raising one of said squeegee or flood bar as the other contacts said screen.

7. The screen printing press of claim 4 wherein said actuator means includes a lever attaching at the lower end to said chassis and at the upper end to said engaging means, said lever being pivotally mounted to a rod on said carriage at a point at least partially above the midpoint of said lever.

8. The screen printing press of claim 4 wherein said fixed surface is formed of a smooth metal and includes a resilient backing, said fixed surface having adjustment means for varying the pressure of said fixed surface against said engaging means.

9. The screen printing press of claim 4 wherein said engaging means includes a brake pad formed of an abrasive surface for frictional engagement with said fixed surface.

* * * * *